United States Patent [19]

Fini

[11] Patent Number: 4,943,329

[45] Date of Patent: Jul. 24, 1990

[54] METHOD FOR MANUFACTURING TIES FROM INTERWOVEN HARP AND WEFT TAPES

[75] Inventor: Carlo Fini, Bologna, Italy

[73] Assignee: A. Testoni S.p.A., Bologna, Italy

[21] Appl. No.: 242,769

[22] Filed: Sep. 12, 1988

[30] Foreign Application Priority Data

Sep. 10, 1987 [IT] Italy ..... 12536 A/87

[51] Int. Cl.[5] ..... A41D 25/00; B32B 31/18; B32B 31/20

[52] U.S. Cl. ..... 156/88; 156/91; 156/148; 156/251; 2/146

[58] Field of Search ..... 156/88, 91, 251, 148, 156/264, 63, 67, 324, 266, 93; 2/144, 146

[56] References Cited

U.S. PATENT DOCUMENTS

| | | | |
|---|---|---|---|
| 1,535,669 | 4/1925 | Kelly | 2/146 |
| 1,724,659 | 8/1929 | Johnston | 2/144 X |
| 1,782,183 | 11/1930 | Strauss | 2/146 |
| 1,849,633 | 3/1932 | Mayers | 2/146 |
| 2,328,063 | 8/1943 | Dodge | 156/88 |
| 2,400,700 | 5/1946 | McCurrach | 2/146 X |
| 3,028,576 | 4/1962 | Gerard | 156/251 |
| 3,358,291 | 12/1967 | Davidowitz | 2/146 |
| 3,486,957 | 12/1969 | Fish et al. | 156/88 |
| 3,619,319 | 11/1971 | Utz | 156/264 X |
| 3,772,112 | 11/1973 | Lyons et al. | 156/88 |

FOREIGN PATENT DOCUMENTS

| | | | |
|---|---|---|---|
| 0909594 | 10/1962 | United Kingdom | 2/146 |
| 1293825 | 10/1972 | United Kingdom | 2/146 |

*Primary Examiner*—Michael W. Ball
*Assistant Examiner*—Jeff H. Aftergut
*Attorney, Agent, or Firm*—Pollock, Vande Sande & Priddy

[57] ABSTRACT

A method for manufacturing ties consisting of interwoven tapes (101, 201). The single tie portions (C1, C2, C3) are cut out from a piece (7) of fabric (1) of interwoven warp and weft tapes (101, 201). This piece of fabric (1) may be bonded by means of a hot-melt adhesive to a base web (4) made of fabric or plastic material foil. Before or after the tie portions (C1, C2, C3) have been cut out, they are peripherally provided with selvedge seams (9) at least along the tie portion cutting lines (8).

6 Claims, 2 Drawing Sheets

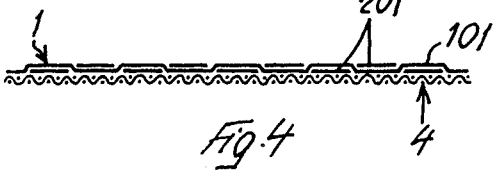
Fig. 4
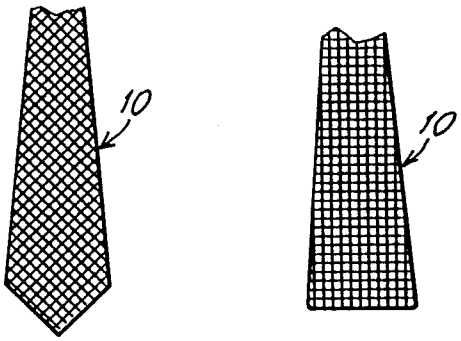
Fig. 5
Fig. 6
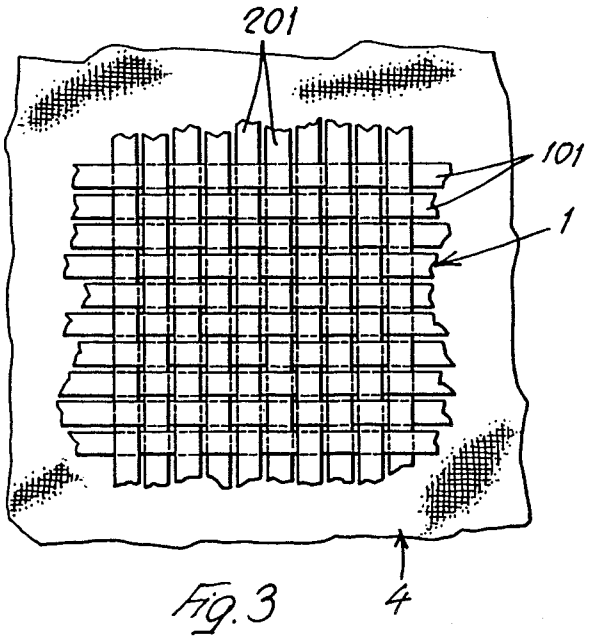
Fig. 3

METHOD FOR MANUFACTURING TIES FROM INTERWOVEN HARP AND WEFT TAPES

FIELD OF THE INVENTION

The invention relates to an easy and accurate method for manufacturing ties that consists of interwoven tapes, particularly fabric tapes on an industrial scale, notwithstanding the consistency of their texture.

The method is characterized by the feature that either the whole tie or single tie portions are cut out from a fabric formed by interwoven warp and weft tapes, and are peripherally provided with a selvedge seam, at least along the edges of the cuts.

SUMMARY OF THE INVENTION

According to one embodiment of the invention, the peripheral selvedge seams are made in the single tie portions before these are cut out from the fabric formed by interwoven warp and weft tapes. Thus, unravelling of the edges is prevented both when the portions are cut out from the fabric and during their subsequent processing.

According to another embodiment of the invention, before the single tie portions are cut out, the fabric formed by interwoven warp and weft tapes is caused to adhere to a thin flexible base web. This base web gives the fabric of interwoven tapes greater cohesion and stability when the tie portions are being cut out, and also when they are subsequently processed, whereby the handling of the cut tie portions and the manufacturing of a tie is facilitated.

When the fabric of interwoven tapes is bonded to a base web, the peripheral selvedge seams in the tie portionsmay be made either before the tie portions are cut out from the thus obtained composite fabric, or after such cutting, due to the greater strength and stability of the edges of the cut tie portions. In any case, it is convenient to provide the said peripheral selvedge seams, since the interwoven and alternately overlapped tapes do not stick uninterruptedly throughout their length on the base web.

With the method according to the invention any suitable fabric of interwoven warp and weft tapes may be used. Thus, for example, the interwoven tapes may be of the same or of different widths, and may be made of any suitable material, such as a fabric of synthetic or natural fibers, or such as leather, plastic, or any suitable non-woven fabric. According to a preferred feature of the invention, when the single tapes are made of a woven fabric, each single tape is provided with selvedges or with selvedge seams, so as to prevent the unravelling of its edges.

Any suitable material, such as, for example, woven or a non-woven fabric of synthetic or natural fibers, or a foil of plastic material, may be used as base web. The base web may be bonded to the fabric of interwoven tapes in any suitable manner and by means of any suitable adhesive, such as, for example, a hot-melt adhesive, and more particularly by means of an adhesive layer which is provided in dried condition on the base web and is made flowable by application of heat.

BRIEF DESCRIPTION OF THE DRAWINGS

Further features and advantages of the invention will clearly appear from the following specification of preferred embodiments of the same, which are shown by way of example in the accompanying drawings.

FIG. 3 shows a piece of fabric of interwoven tapes bonded to a base web.

FIG. 4 is a schematic sectional view through the composite fabric according to FIG. 3.

FIGS. 5 and 6 are front views showing two different types of ties made from fabrics of interwoven tapes.

DESCRIPTION OF THE PREFERRED EMBODIMENTS

Figure 1:
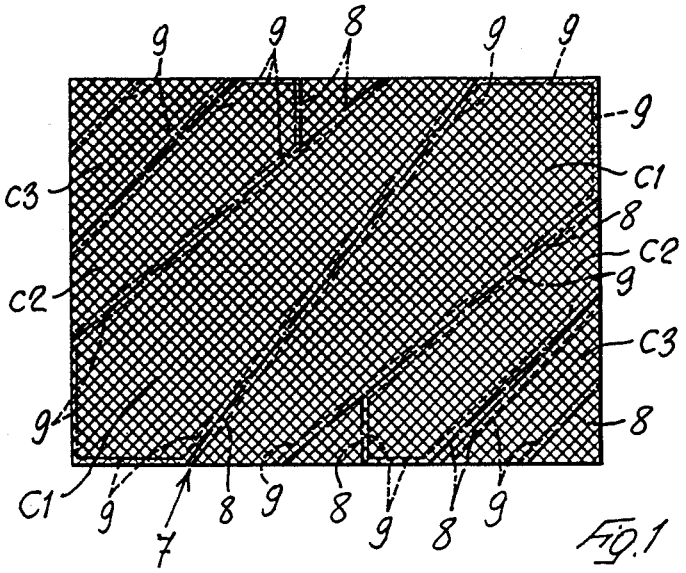
FIG. 1 shows a piece of fabric of interwoven warp and weft tapes, with the single tie portions cut out.

As shown in the drawings, the ties according to the invention are made from a fabric 1 in which the weft and the warp, rather than consisting of yarn, consist of tapes 101, 201 which are preferably made of woven fabric, in such a manner that the fabric 1 of interwoven weft and warp tapes 101, 102 will have a bold pattern in the form of a mat-like weave.

The tapes 101, 201 may be made of any suitable material or a combination of materials that will give the tapes aesthetically pleasing properties of lightness, resiliency, and wear resistance. Advantageously, the tapes 101, 201 may be made of a synthetic material, such as rayon, or of silk, cotton, or any other suitable natural fibers.

The tapes 101, 201 have longitudinal edges not subject to fraying, since they are provided with a selvedge, and may be provided with longitudinal seams for ornamental purposes.

The tapes 101, 201 may be woven so as to present a satiny surface, such that the weft and warp tapes will appear either glossy or opaque depending on the incidence of light thereon.

The tapes 101, 201 used as weft and warp tapes in the fabric 1 are preferably alike in shape, colour and size; it is however understood that they may differ in one or more of these respect. They may be of only one color, or of any combination of colors, and with any desired pattern.

Aesthetically satisfying results have been obtained by using tapes 101, 201 having a width less than 1 cm, preferably a width of about 5 to 6 mm or of 3 mm, it is, however, understood that the tapes 101, 201 may have any suitable width different from these specified abuse.

According to a modified embodiment of the invention, (not shown) the fabric 1 may be made with the combined use of tapes and threads, for example, of weft ribbons and warp threads, or vice-versa.

To enable the fabric 1 of interwoven tapes 101, 201 to be used for making ties, it should be given textural coherence in order to prevent any relative displacement of the tapes 101, 201 which would lead to the formation of disagreeable and unaesthetic openings or gaps.

Figure 2:
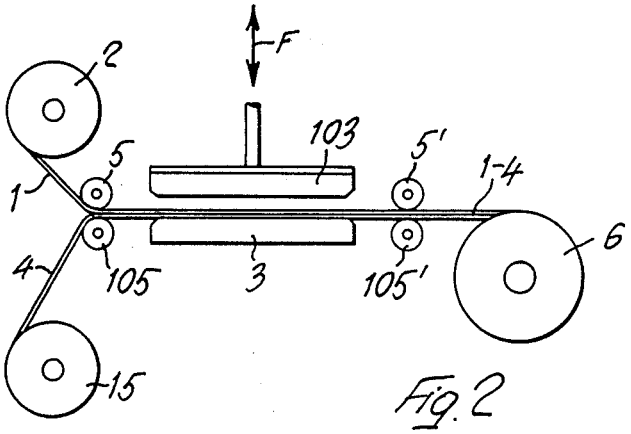
FIG. 2 is a schematic side elevation of a device for bonding a base web to a fabric of interwoven tapes.

This problem is solved as follows. As shown in FIG. 2, the fabric 1 of interwoven tapes 101, 201 issuing from the loom is first wound up on a bobbin 2 and is then unwound therefrom and fed between parallel plates 3, 103 of a press, lower plate 3 being stationary and upper plate 103 being restically displaceable as shown by the double arrow F. One or both of these plates can be heated.

Before the insertion of the fabric 1 of interwoven tapes between plates 3, 103, to be pressed and heated, the fabric is superimposed upon a base web 4 unwound from a bobbin 15, and which, at least on its face turned toward fabric 1, has been pretreated with a hot-melt adhesive, more particularly coated with an adhesive layer in dried condition, which is then made flowable by application of heat. The result is that when the hot plate 103 is drawn down on the plate 3, fabric 1 and base web 4 become bound to each other. Thereafter, when plate 103 is lifted up, the length of composite fabric 1, 4, having just been hot bonded, is wound up on a bobbin 6.

Numerals 5, 105 and 5', 105' denote pairs of idle and-/or powered rollers which may be placed upstream and downstream of the press 3, 103 in order to facilitate the longitudinal movement and positioning of fabric 1 and base web 4.

It is understood that the apparatus in FIG. 2 is shown merely for illustrative purposes, and that any other, even continuously operated, suitable means may be used for hot bonding the fabric 1 of interwoven tapes 101, 201 and the base web 4.

In order to improve the bonding effect, the surface of fabric 1 which is intended for a close union with base web 4 may also be pretreated with a hot-melt adhesive.

The base web 4 may be made from any suitable, sufficiently light and resilient material of reduced thickness. It may be made of a woven fabric of synthetic or natural fibers, or of a non-woven fabric, or it may be formed with a film of a suitably perforated, high temperature-resistant synthetic material. It may even consist of a net formed only by a hot-melt adhesive.

The composite fabric 1, 4 has a width dimension which ideally is in the order of one meter, so that by oblique cutting a strip about 1.30 to 1.45 m in length can be obtained, as suitable for making a one-piece seamless tie.

However, with presently available looms it is only possible to make a fabric 1 of interwoven tapes having a width of about 70 cm. From this fabric 1 provided with the base web 4, pieces 7 of 70×50 cm or of 70×55 cm are obtained, as shown in FIG. 1. From one-half of a piece 7 of composite fabric 1, 4, three side-by-side tie portions C1, C2, C3 are cut out in means of oblique cuts 8 (shown by dash-and-dot-lines), these portions having a shape and width such that they can be attached to one another in proper succession to form a tie. A further set of like tie portions C1, C2, C3 arranged in the reverse direction are cut out from the other half of the same piece 7 of composite fabric 1, 4, and are used for making another tie.

It is understood that the cutting pattern in FIG. 1 is shown merely for illustrative purposes, and may be widely modified. By use of a different pattern of slanting cuts 8, or of any other type of cuts, ties may be formed from two portions or, as specified above, from only one piece.

Before or after the said cutting step of a piece 7 of composite fabric 1, 4, the edges of the tie portions C1, C2, C3, are provided along their perimeter with selvedge seams 9, such that the interlacement of the fabric 1 of interwoven tapes will not become unravelled. Preferably, but not indispensably, the selvedge seams 9 are made also along the tie portion edges which are not to be conjoined, as shown in FIG. 1. It is however understood that the selvedge seams 9 may be made along the whole perimeter of the tie portions or the one tie piece.

At this stage, the tie manufacturing cycle continues by conventional steps which may be summarized as follows:

(a) the tie portions C1, C2, C3, or a different number of tie portions intended for making a tie, when more than one in number, are conjoined by sewing by machine;

(b) a lining is applied to the non-visible or inside faces of the two end sections, the so-called "palm" (large end) and "tail" (short end), of a tie having been semi-manufactured according to the preceding step;

(c) the partly lined semi-manufactured tie is ironed for a first time;

(d) the tie core, which is called "the stem", usually consisting of two pieces to be conjoined, is prepared;

(e) the semi-manufactured tie with its stem is fitted on a special shaping fixture on which the tie is given a tubular form and is suitably tacked by means of pins, a small pin being permanently placed in the palm, in order to keep it closely connected;

(f) the connected longitudinal edges of the tie are hand-sewn, and respective loops are formed at both ends of the loosely stitched seam, so as to give the seam the required yieldingness and the whole tie the required pliability, and the ends of the seam are then secured by making a few cross-stitches, called "bars";

(g) the trade mark is printed on the tie; and (h) the finished tie is again ironed, and may be packed in a suitable wrapper.

According to a different tie-manufacturing method, in lieu of the above manual step (e), an apparatus known by the trade name "Liba" may be used to give the ties a tubublar form, by having a "hand stitch" seam made on the reverse side thereof. Thereafter, by using a special stick, the ties which have been sewn on their reverse side are turned over, with their right side out. The two end sections of a tie are then fitted on a suitable shaping fixture of cardboard, and the aforementioned loops and bars are made, whereupon the operation is completed by carrying out steps (g) and (h).

It is understood that numerous modifications may be made in to the method according to the invention, which may, for example, use products other than hot-melt adhesives, such as self-adhesive bonding agents or natural and/or synthetic glues, for use in fastening together the fabric 1 of interwoven tapes 101, 201 and the base web 4. Textile material hoses may be used in place of tapes 101, 201.

Instead of being obliquely cut, the composite fabric 1, 4 may be cut in the direction of its width or of its length. In such a modified embodiment, the weft and the warp of the fabric, instead of being orientated at 45° to the longitudinal axis of the tie 10, as shown in FIG. 5, will be respectively parallel and perpendicular to said axis, as shown in FIG. 6.

According to a further embodiment, the composite fabric 1, 4 may still be cut obliquely, but at an inclination other than 45°.

By using a base web 4 with suitable properties, insertion of the stem into a tie, according to step (d), may be omitted.

In any of the embodiments dislosed above, the piece of composite fabric 1, 4 may be replaced with a piece of simple fabric 1 of interwoven warp and weft tapes 101, 201, i.e., without a base web 4, so that by means of cuts 8 the tie portions C1, C2, C3 may be cut out from a simple piece 7 of fabric 1 of interwoven tapes 101, 201. In this instance, before the cuts 8 are made so as to obtain the tie portions C1, C2, C3, in these tie portions selvedge seams 9 are made at least along the predetermined tie portion cutting lines, and preferably along the entire perimeter of each tie portions C1, C2, C3, for example as shown in FIG. 1.

I claim:

1. A method of manufacturing ties comprising the steps of (a) forming a piece of composite fabric from interwoven warp and weft tapes each having a width of up to 10 mm, at least one of said weft tapes and said warp tapes having a visible satiny surface selectively appearing glossy and opaque, depending on incidence of light thereon;

(b) placing said piece of composite fabric on a piece of thin, flexible base web;

(c) bonding said composite fabric to said base web by means of a hot-melt adhesive;

(d) cutting laterally adjacent tie portions from said piece of composite fabric, said tie portions having a shape and width such that said tie portions are adapted to the attached to one another in proper succession to form a tie;

(e) providing said portions with peripheral selvedge seams prior to step (d), at least along tie portion cutting lines in said fabric; and (f) sewing said cut tie portions together.

2. The method according to claim 1, wherein the width of said single tapes is 5 to 6 mm.

3. The method according to claim 1, wherein both said weft tapes and said warp tapes have a said visible satiny surface.

4. The method according to claim 1, weherin said fabric is provided with selvedge seams prior to bonding with a said base web.

5. The method according to claim 1, wherein said fabric of interwoven tapes comprises a fabric whose single tapes consist of textile material hoses.

6. The method according to claim 1, wherein said fabric of interwoven warp and weft tapes and said base web provided with a layer of hot-melt adhesive are unwound from respective bobbins, and are passed in superposed relation between heated plates of a press.

* * * * *